US006543103B1

(12) United States Patent
Robert

(10) Patent No.: US 6,543,103 B1
(45) Date of Patent: Apr. 8, 2003

(54) THEMATIC CASKET AND URN ASSEMBLY

(75) Inventor: Pascal Robert, Norbertville (CA)

(73) Assignee: Cercuiels Vic Royal, Inc., Victoriaville (CA)

( * ) Notice: Subject to any disclaimer, the term of this patent is extended or adjusted under 35 U.S.C. 154(b) by 0 days.

(21) Appl. No.: 09/368,749

(22) Filed: Aug. 5, 1999

(30) Foreign Application Priority Data

Aug. 7, 1998 (CA) ..... 2242113

(51) Int. Cl.[7] ..... A61G 17/00
(52) U.S. Cl. ..... 27/10; 27/19
(58) Field of Search ..... 27/10, 1, 2, 35, 27/19, 14; D99/8, 13

(56) References Cited

U.S. PATENT DOCUMENTS 3,025,624 A * 3/1962 Harrell
4,357,741 A * 11/1982 Winbum et al. ..... 27/19
4,571,790 A * 2/1986 James, III
5,604,965 A * 2/1997 Shaw et al.
5,675,877 A * 10/1997 Lewis ..... 27/19
D390,321 S * 2/1998 Maple et al.
D418,961 S * 1/2000 Biondo et al.
6,138,335 A * 10/2000 Drawbaugh et al.
D433,585 S * 11/2000 Bowers et al.
6,237,202 B1 * 5/2001 Agee et al. ..... 27/14

* cited by examiner

*Primary Examiner*—William Miller
(74) *Attorney, Agent, or Firm*—St. Onge Steward Johnston & Reens LLC

(57) ABSTRACT

A thematic assembly for a casket, including a casket, an urn, a panel to be placed on a crown of the casket, a display shelf and at least one removable corner ornament for a casket including fasteners allowing the corner ornament to be readily removed from the casket without requiring the use of any tools. The purpose for providing such assembly is to allow the family of the deceased to execute a more personal and thematic funeral ceremony according to the deceased's wishes or according to the family's preferences. The elements composing the assembly are readily removable so that relative and/or close friends of the deceased may retain them after the funeral ceremony in remembrance of the latter.

10 Claims, 6 Drawing Sheets

THEMATIC CASKET AND URN ASSEMBLY

FIELD OF THE INVENTION

The present invention relates to casket ornaments. More precisely, it relates to removable corner ornaments for a casket and to a kit incorporating the same.

BACKGROUND OF THE INVENTION

It is known in the art to provide a casket with angled corners in order to place corner ornaments there. Families of the deceased can then choose between a number of different ornaments with which to adorn the casket, according to their own taste or to the deceased's wishes.

These corner ornaments have a design on the front face thereof, and are provided with an extending pin at the rear thereof. The pin is inserted into a hole provided on the angled corner for that purpose. The ornament is held in place with fastening means, such as a butterfly nut, from the inside of the casket. This is a major inconvenience, since should the family wish to keep the corner ornaments, these can only be removed from the inside of the casket. It is most undesirable, when the casket is at the cemetary, to a have a person reach into the casket (while the body lies therein) and manually unscrew the butterfly nuts in order to remove the ornaments. Furthermore, even if there was a delicate way of removing the ornaments, the existence of the protruding pin makes it difficult for the family to expose the ornaments in their home, or elsewhere.

In order to obviate this problem, one solution is to provide the ornaments with a pair of male fasteners, having an enlarged head, which matingly cooperate with a corresponding female opening in order to removably fasten the ornament to the corner. However, the use of such an arrangement does not provide for adequate retention, since the ornaments can fall off, and can cause misalignment problems because the tolerance required to properly align the ornaments is high.

Furthermore, there is a need for permitting the family to choose and arrange the ornaments as they choose, and for permitting the family to retain the ornaments and expose them properly.

SUMMARY OF THE INVENTION

It is an object of the present invention to provide a thematic casket assembly for ornamenting a funeral ceremony. The casket is of the type having four corner surfaces, each of which are at an angle with respect to a side wall of the casket. The thematic casket assembly according to the present invention comprises a panel to be placed on a crown of the casket, a display shelf and at least one removable corner ornament adapted to be attached to a corresponding corner on surface of the casket. The display shelf and the at least one corner ornament are provided with a thematic design on the front face thereof whereby during the funeral ceremony, the panel is placed on the crown of the casket and the corner ornaments are secured on the display shelves which are mounted on a corresponding corner surfaces of the casket.

The present invention is also concerned with a thematic urn assembly comprising a decorative panel to be placed nearby the urn and a ornament adapted to be attached on the surface of the urn. The thematic urn assembly also comprises a display shelf for receiving and displaying the ornament when it is removed from the urn.

It is another object of the present invention to provide a removable corner ornament for a casket that may be readily detachable from the casket that is without the use of any tools.

It is a further object of the present invention to provide a kit for ornamenting a casket, comprising at least one corner ornament to be placed on the casket. The corner ornaments are provided with a design on the front face thereof and attaching means on the rear face thereof for fixing the corner ornament on a corner surface of the casket. The kit also comprises a display shelf for receiving and displaying at least one corner ornament when it is detached from the casket.

In accordance with the present invention it is also possible to use the removable corner ornament as a decorative base of an urn.

It should be understood that more than one type of ornament may be placed on a casket, and the kit provides for this selection.

BRIEF DESCRIPTION OF THE DRAWINGS

The present invention and its advantages will be more easily understood after reading the following non-restrictive description of preferred embodiments thereof, made with reference to the following drawings in which.

DETAILED DESCRIPTION OF THE INVENTION

Figure 1:
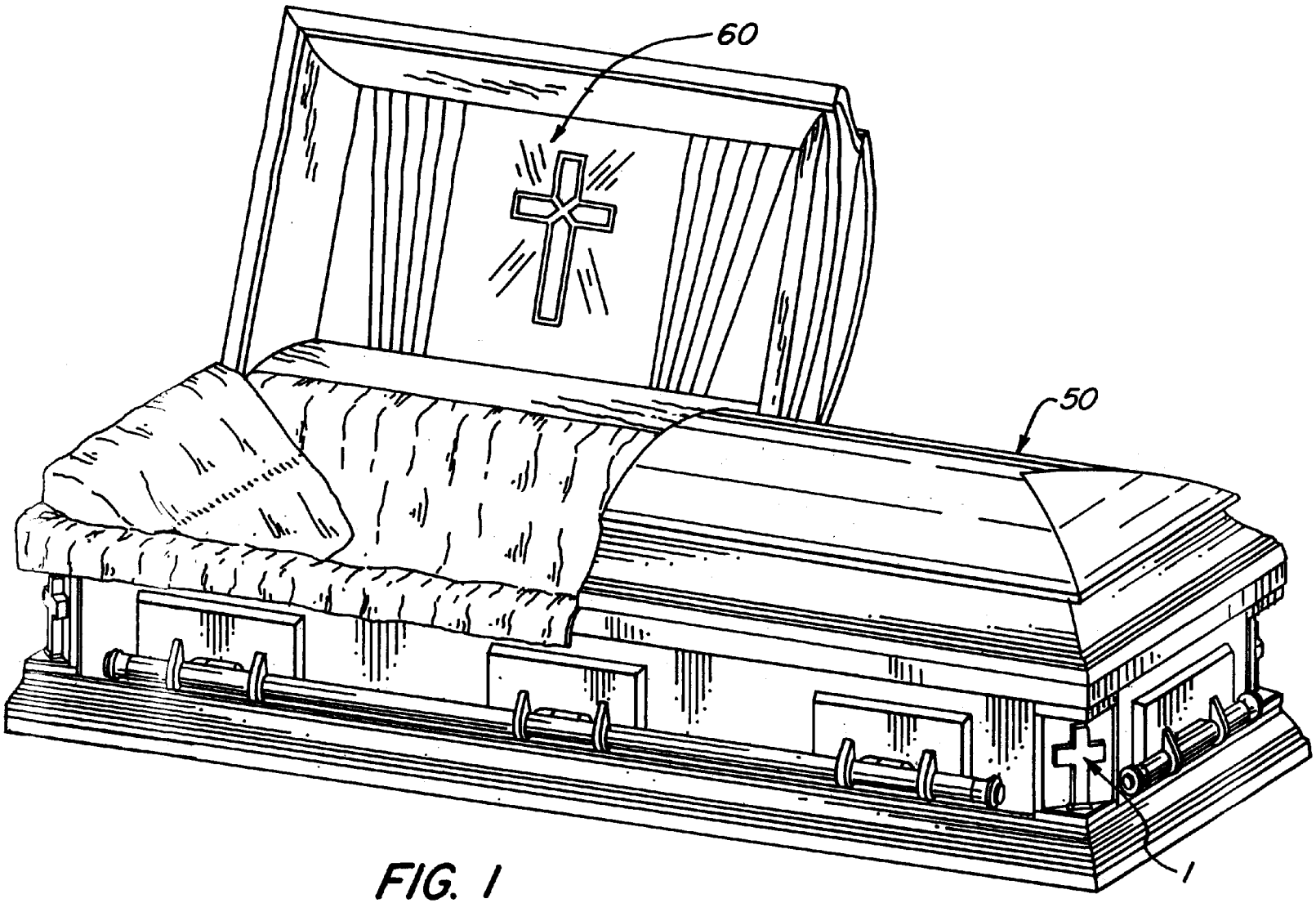
FIG. 1 is a schematic representation of a thematic casket assembly according to a preferred embodiment of the invention.

FIG. 1 shows a thematic casket assembly according to the present invention. As can be seen, the casket assembly comprises a panel (60) that is adapted to be placed on the crown of a casket (50). The casket assembly further comprises at least one corner ornament (1) which is secured on a display shelf (5). The removable corner ornament is placed on a corner of the casket. As can be seen in FIG. 8, the casket is of the type comprising four corner surfaces, each of which are at an angle with respect to the sidewall of the casket.

Therefore, during the funeral ceremony, the panel is installed on the crown of the casket, the corner ornament is secured on a display shelf, which is in turn mounted on a corresponding corner surface of the casket.

Since the casket assembly is composed of elements which are readily removable, at the end of the funeral service, at least one of the removable corner ornaments and the panel can be instantly removed from the casket and presented to the family of the deceased.

Such thematic casket assembly allows the family of the deceased to execute a more personal and thematic funeral ceremony according to the deceased wishes or according to the family's preferences.

According to a preferred embodiment of the present invention, the thematic casket assembly may comprise four corner ornaments wherein each of said corner ornament is provided with identical thematic designs on the front thereof. Alternatively, at least two of the four corners ornament may be provided with identical thematic design on the front face thereof.

Hence it should be also noted that the four ornaments need not all be identical, and that a selection of more than one ornament can be placed on the corners (5).

Figure 2:
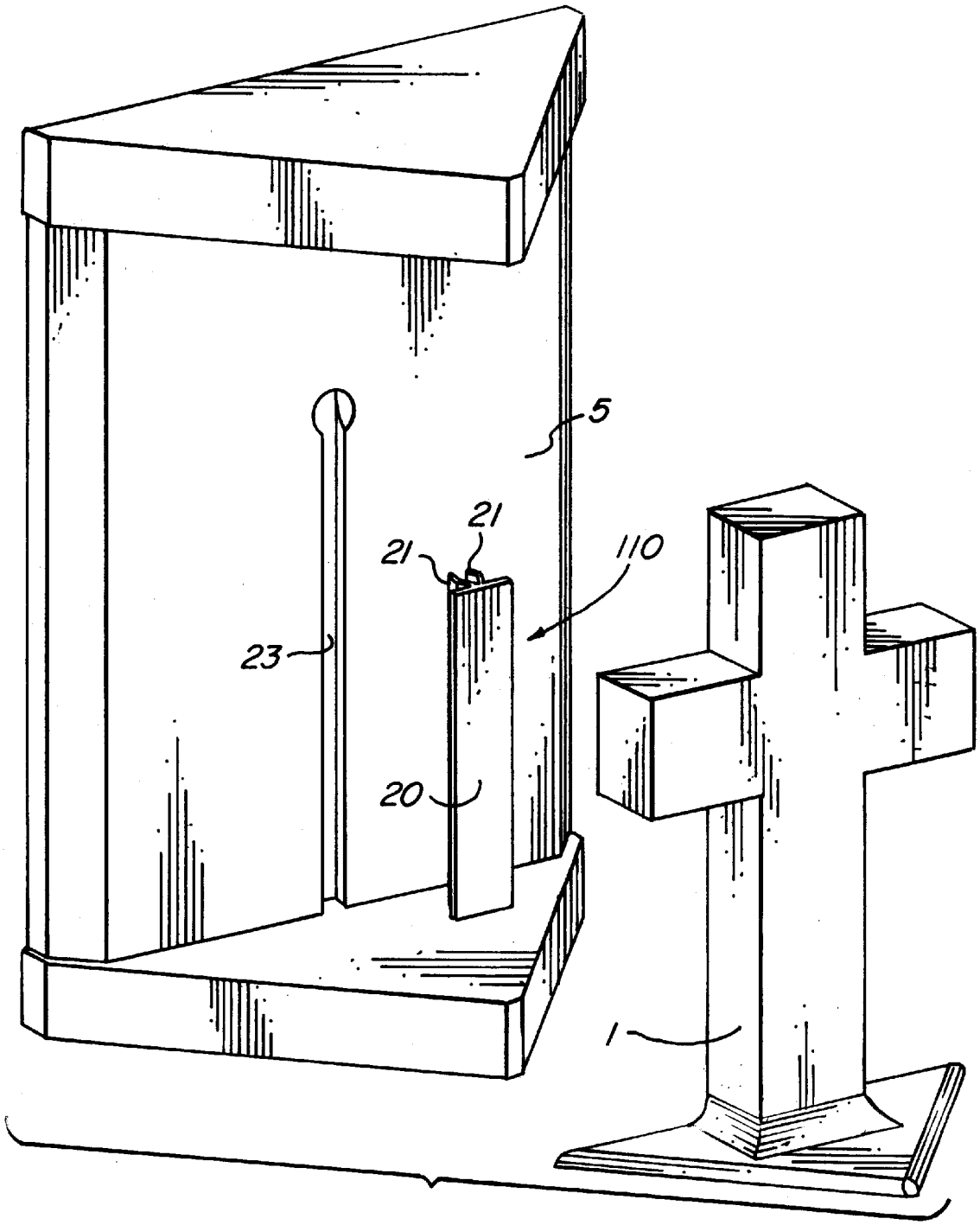
FIG. 2 is an exploded view of a removable corner ornament according to a preferred embodiment of the invention.

Referring now to FIG. 2, it is shown the basic structure of a removable corner ornament (1) according to the present invention. The ornament (1) is provided with a fastener (20) for securing the ornament (1) to a corner of a casket (50).

Figure 3:
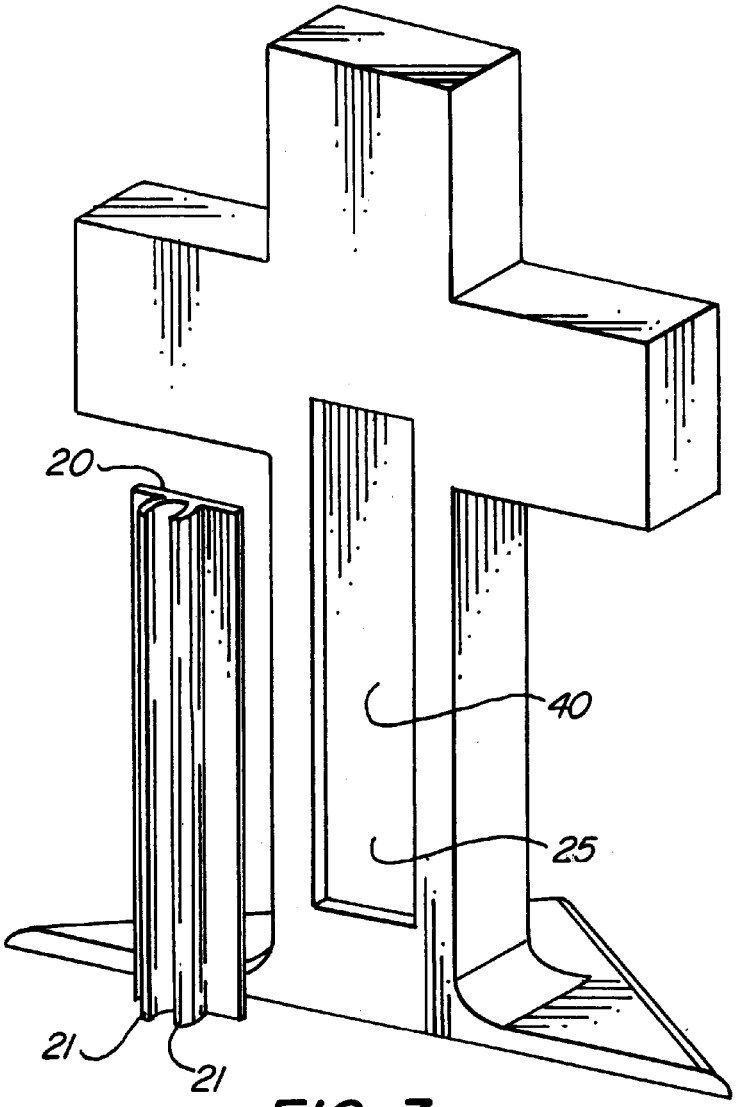
FIG. 3 is a rear view thereof.
Figure 4:
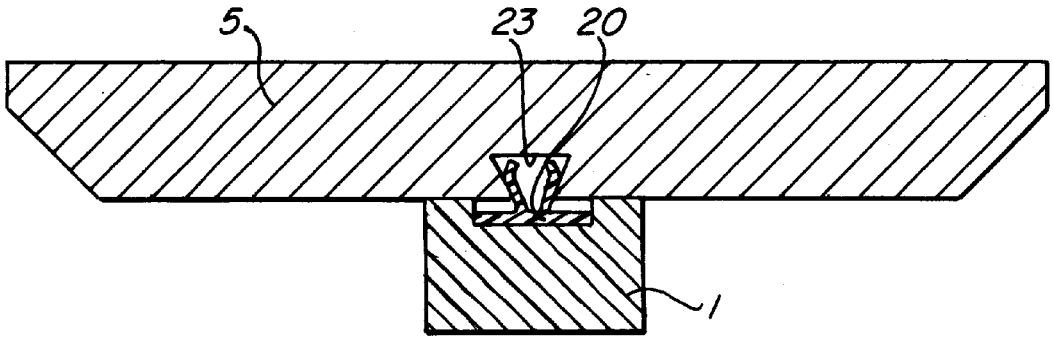
FIG. 4 is a cross-sectional view thereof.

As shown in FIGS. 3 and 4, the fastener (20) may comprise a pair of longitudinal outwardly projecting flanges (21) adapted to be inserted in an opening which consists essentially of a longitudinal groove (23) on the corner surface of the casket. The longitudinal groove (23) has a width slightly smaller than the one defined by the outwardly projecting flanges (21).

Preferably, the fastener is placed at a bottom portion (25) of the removable corner ornament (1) so to allow proper alignment on the corner of the casket.

In a preferred embodiment, the fastener (20) forms an integral part of the removable corner ornament.

In an other preferred embodiment, the fastener (20) is permanently fixed to the back of the ornament such as by gluing or stapling. In such case, the ornament (1) can be in two parts, one being a back plate (110) provided with the extruded PVC (20), having at the front thereof a design which is glued or otherwise fastened thereto. FIGS. 8(*a*), 8(*d*) and 7(*e*) are such examples.

In any case, the fastener may be made of a piece of extruded polyvinyl chloride (PVC).

Figure 5:
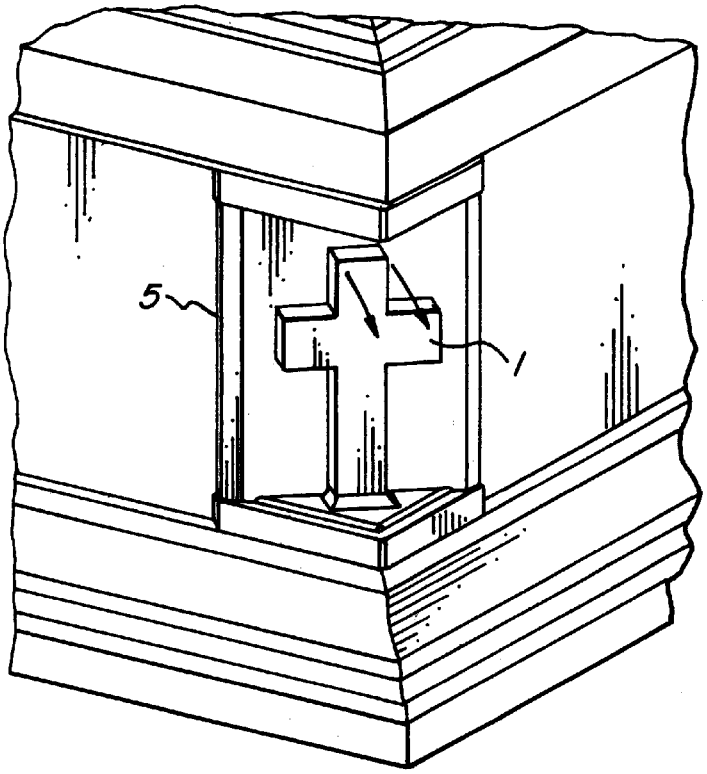
FIG. 5 is a schematic representation of the manner of removing a corner ornament from a casket.
Figure 6:
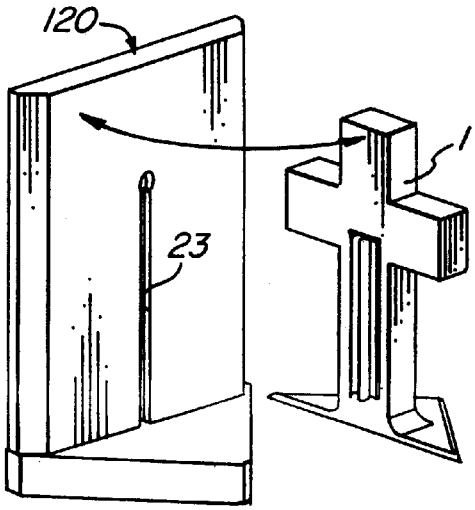
FIG. 6 is a perspective view of a display shelf and a removed ornament.

FIGS. 5 and 6, is a schematic representation of the manner to place and remove the ornament (1) on a casket (50) according to the invention. The removable corner ornament (1) may be readily snapped in the opening of the respective corner surface. Since the width defined by the groove (23) is smaller than the width defined by the flanges (21), it serves to maintain the ornament (1) in position to the corner. Accordingly, the corner ornament is removed by simply pulling it away in the opposite direction. It should be noted that sufficient force is required, so that the ornament will not accidentally fall off the corner (5).

Figure 7:
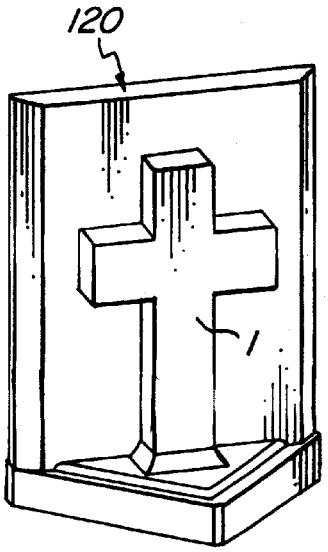
FIG. 7 is a perspective view of the display shelf of FIG. 6, with the ornament placed thereon.
Figure 8A:
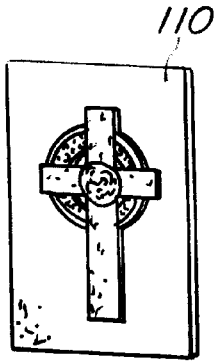
FIGS. 8*a* to 8*g* are schematic representations of various ornaments which can be used according to the present invention.
Figure 8B:
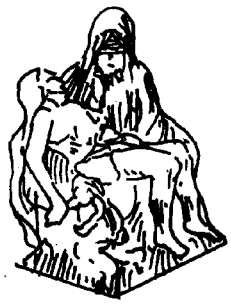
Figure 8C:
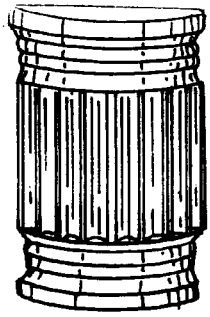
Figure 8D:
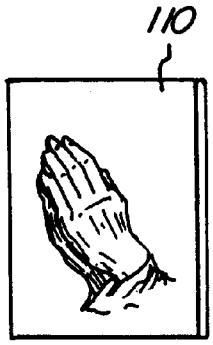
Figure 8E:
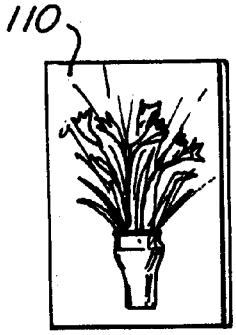
Figure 8F:
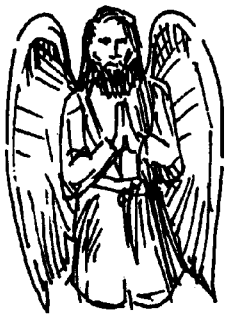
Figure 8G:
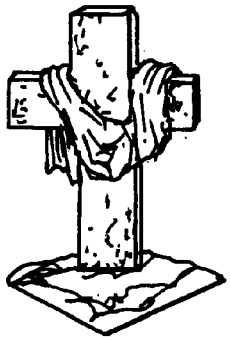

FIG. 7 is a front view of a removable corner ornament when it is removed from the casket at the end of the funeral ceremony.

Accordingly, a casket (50) provided with the appropriate corner (5), can accept a variety of ornaments (1) which can be placed on the casket during the ceremonies, and removed therefrom to provide the family or friends of the deceased with an appropriate memento.

FIG. 8 shows different types of ornaments, which can be placed, on a corner according to the invention.

It should be noted that the ornament can be directly provided with, for example, a recess (40) to receive the extruded PVC piece (20), as shown on FIG. 2.

As mentioned above, the ornament may be used as a decorative item such as a base for an urn. When the ornaments (1) are removed from the casket, they can be placed on a display shelf (120), which is provided with a longitudinal groove (23) for receiving the flange (21) of the corner ornament (1), as better shown on FIGS. 5 and 6. The panel (60) which is placed on the crown and which can bear the same design as the ornament (1), or could bear a different design, as shown on FIG. 8.

Figure 9:
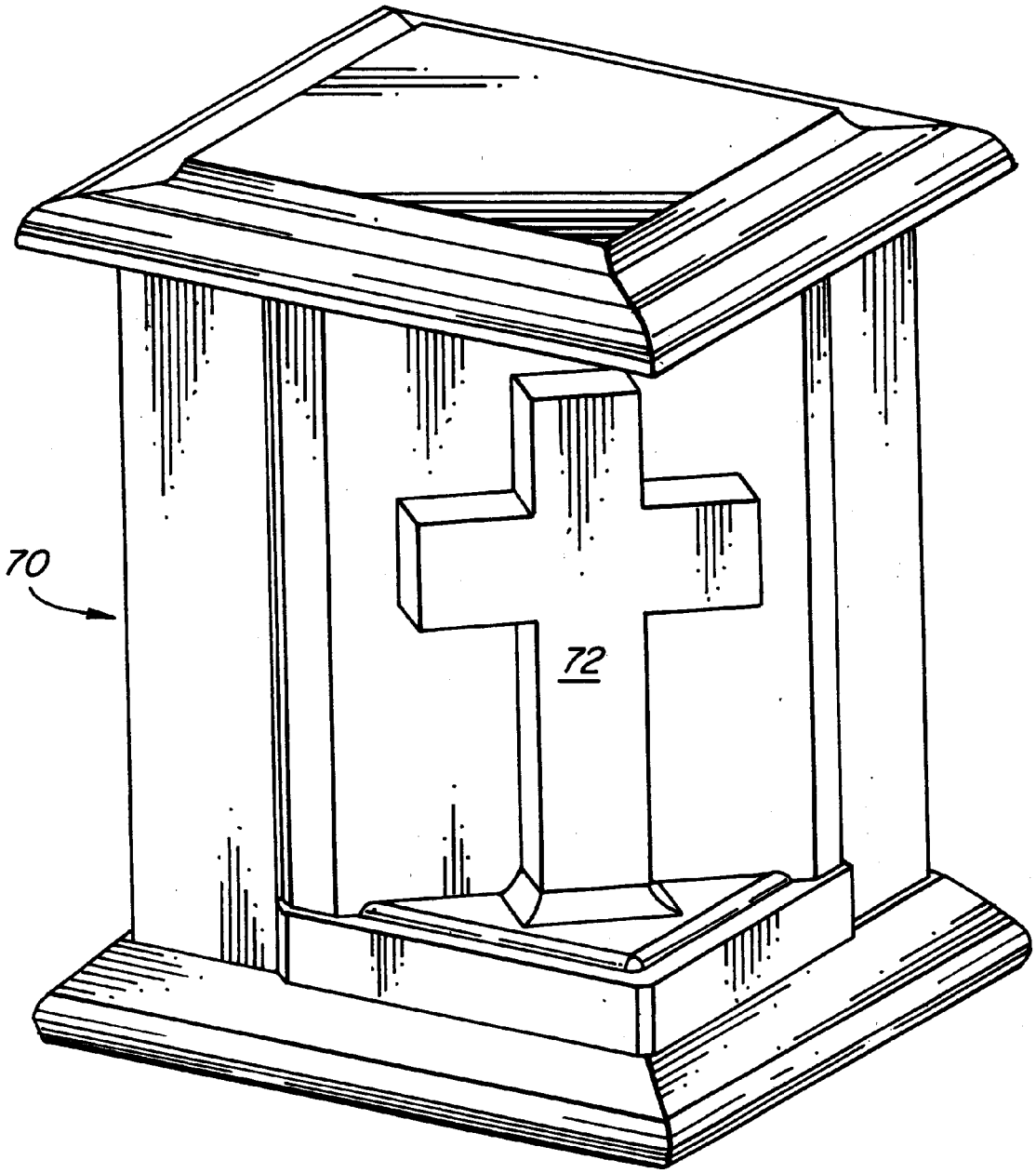
FIG. 9 is a perspective view of a thematic urn assembly according to the preferred embodiment of the invention.

Referring to FIG. 9, it is shown a thematic urn assembly according to the present invention. The thematic urn assembly comprises an urn (70) having a front face wherein an ornament (72) may be installed.

The display shelf and ornament are readily detachable so that at the end of the funeral ceremony, the ornament and display shelf may be removed from the urn and given to the family of the deceased. Similarly, the decorative panel may be removed from its location and presented to the family of the deceased.

Although the present invention has been explained hereinabove by way of a preferred embodiment thereof, it should be pointed out that any modifications to this preferred embodiment within the scope of the present description is not deemed to alter or change the nature and scope of the present invention.

What is claimed is:

1. A thematic casket assembly for ornamenting a casket in a funeral ceremony, wherein said casket has four corner surfaces, each of the corner surfaces being at an angle with respect to a side wall of said casket, said assembly comprising:

a panel to be placed on a crown of said casket;

at least one display shelf provided with one of said four corner surfaces, which has a continuous elongated groove; and at least one removable corner ornament provided with a fastener having a pair of elongated longitudinal flanges and which is adapted to be removably attached to one of the four corner surfaces of said casket;

wherein said groove has a length greater than a length of said longitudinal flanges;

said panel and said at least one corner ornament being provided with a thematic design on a front face thereof whereby during said funeral ceremony, said panel is placed on said crown of said casket, said at least one corner ornament is secured on a corresponding corner surface of said casket upon insertion of the fastener into the groove; and whereby when said funeral ceremony is over, at least one removable corner ornament is placed on said display shelf and given to the family of the deceased.

2. A thematic casket assembly according to claim 1, further comprising three more corner ornaments, wherein each of the four corner surfaces receives the removable corner ornament.

3. A thematic casket assembly according to claim 2, wherein each of said corner ornaments are provided with an identical thematic design on the front face thereof.

4. A thematic casket assembly according to claim 2, wherein at least two of said four corner ornaments are provided with identical thematic design on the front face thereof.

5. A thematic casket assembly comprising a casket and a kit for ornamenting said casket in a funeral ceremony, wherein said casket has four corner surfaces, each of the corner surfaces being at an angle with respect to a side wall of said casket, said kit comprising: a panel to be placed on a crown of said casket, a display shelf having a continuous elongated groove and at least one removable corner ornament adapted to be attached to one of the four corner surfaces of said casket, said panel and said at least one corner ornament being provided with a thematic design on a front face thereof; and a fastener attached to said at least one corner ornament for removably fixing said at least one corner ornament to said one of the four corner surfaces, said fastener including a pair of elongated longitudinal flanges spaced from one another at a distance greater than said width of the groove, and wherein said groove has a length greater than a length of said longitudinal flanges.

6. A casket assembly comprising a casket and a kit for ornamenting said casket, said kit comprising at least one corner ornament to be placed on said casket, said corner ornament being provided with a design on a front face thereof and a fastener on a rear face thereof for removably fixing the corner ornament on a corner surface of said casket and a display shelf for receiving and displaying said at least one corner ornament, said display shelf having a continuous elongated longitudinal groove having a width, said fastener being provided with a pair of elongated longitudinal flanges spaced from one another at a distance greater than said width of the groove, wherein said groove has a length greater than a length of said longitudinal flanges.

7. A kit according to claim 6, further comprising a panel adapted to be placed on a crown of said casket.

8. A kit according to claim 6, wherein said kit further comprises three more corner ornaments, wherein each of corner surfaces receives a respective movable corner ornament.

9. A kit according to claim 8, wherein at least two of said four corner ornaments are provided with an identical design on the front face thereof.

10. A kit according to claim 9, wherein each of said four corner ornaments are provided with an identical design on the front face thereof.

* * * * *